US006202609B1

(12) United States Patent
Metz

(10) Patent No.: US 6,202,609 B1
(45) Date of Patent: Mar. 20, 2001

(54) ELECTROMAGNETIC CONTROL DEVICE

(75) Inventor: Andreas Metz, Bergisch Gladbach (DE)

(73) Assignee: Continental ISAD Electronic Systems GmbH & Co. KG, Landsberg (DE)

( * ) Notice: Subject to any disclaimer, the term of this patent is extended or adjusted under 35 U.S.C. 154(b) by 0 days.

(21) Appl. No.: 09/530,065

(22) PCT Filed: Sep. 29, 1998

(86) PCT No.: PCT/EP98/06178

§ 371 Date: Apr. 24, 2000

§ 102(e) Date: Apr. 24, 2000

(87) PCT Pub. No.: WO99/22122

PCT Pub. Date: May 6, 1999

(30) Foreign Application Priority Data

Oct. 23, 1997 (DE) ..... 197 46 832

(51) Int. Cl.[7] ..... F01L 9/04; F01L 3/24

(52) U.S. Cl. ..... 123/90.11; 123/90.24; 123/198 D; 123/182.1

(58) Field of Search ..... 123/90.11, 90.24, 123/90.25, 90.26, 90.31, 198 D, 182.1

(56) References Cited

U.S. PATENT DOCUMENTS 4,762,095 * 8/1988 Mezger et al. ..... 123/90.11

FOREIGN PATENT DOCUMENTS

| | | |
|---|---|---|
| 30 24 109 | 1/1982 | (DE) . |
| 35 13 103 | 10/1986 | (DE) . |
| 196 51 914 | 6/1998 | (DE) . |
| 0 317 725 | 5/1989 | (EP) . |
| 0 312 216 | 1/1993 | (EP) . |
| WO 95/00787 | 1/1995 | (WO) . |
| WO 95/00959 | 1/1995 | (WO) . |

* cited by examiner

*Primary Examiner*—Weilun Lo
(74) *Attorney, Agent, or Firm*—Walter Ottesen

(57) ABSTRACT

In a valve control, which operates in the normal case purely electromagnetically without return spring and ancillary means of this kind, the unwanted collision between piston base and valve plate (8) is to be reliably avoided. An electromagnetically operating control device (2) for at least one gas-exchange valve in an internal combustion engine has a shaft (safety lock shaft) (18), which is provided with at least one cam (16), the shaft being drivable via the crankshaft at a ratio of 1:1. In the event of a disturbance of the electromagnetic valve actuation, the valve mechanism corresponding to the particular control device (2) can be displaced at least so far that the valve plate (8) has left the collision position thereby reliably avoiding a collision between piston base and valve plate (8). The control device can be used in a reciprocating engine, a piston compressor or a machine having the same operating principle.

4 Claims, 1 Drawing Sheet

ELECTROMAGNETIC CONTROL DEVICE

FIELD OF THE INVENTION

The invention relates to an electromagnetic control device for a gas-exchange valve in a reciprocating-piston engine, a piston compressor or a machine having the same operating principle.

BACKGROUND OF THE INVENTION

In contrast to two-stroke engines, in four-stroke spark ignition engines and diesel engines, the Carnot type cyclic process is controlled with the aid of gas-exchange valves. These valves were earlier opened by means of a camshaft rotating at half rpm via rocker arms in the rhythm of the work strokes and were again closed by means of spring mechanisms operating as a clamping device.

Because of the relatively large mass of the rocker arms, which move up and down in the rhythm of the strokes, these rocker arms have been replaced in high-speed engines more and more by valve rods drivable by an above-lying camshaft.

All mechanically operating valve controls, which operate via cams, operate more or less sluggishly and do not permit any variable influencing of the control. For this reason, various electromagnetically operating valve controls have been suggested.

Electromagnetically operating valve controls of this kind have, as a rule, an electromagnetic control device for opening the valve and a clamping device for closing the valve. The clamping device is configured as a mechanical spring. Without going into details of configurations of this kind, reference can be made, for example, to the publications: German Patents 3,024,109 and 3,513,103 as well as PCT applications WO 95/00787 and WO 95/00959.

Furthermore, valve control devices have been suggested wherein the basic functions continue to be mechanically executed and additional functions, for example, different control times and like variables are realized, however, with electromagnetic ancillary devices (see, for example, EP 0,312,216).

The disadvantage of the above-mentioned construction principles is essentially that one does not do without the mechanical actuators which are controllable only to a limited extent and, for reasons of safety, one cannot do without them. If one would do without the mechanical components and especially the return springs operating as a clamping device, then, in the case of a loss of power, a collision between piston base and valve plate could not be avoided.

SUMMARY OF THE INVENTION

It is an object of the invention to reliably avoid, even in the case of a loss of power, the unwanted collision between piston base and valve plate in a valve control operating, in the normal case, purely electromagnetically without return spring and like ancillary means.

The invention solves this problem with the aid of the safety lock shaft. This mechanically driven safety lock shaft is driven via the crankshaft in the ratio 1:1 and runs "empty" (without contact). This means that the electromagnetic valve control has complete freedom with respect to the selection of the precise closure time point, the selection of the closure duration and the selection of the valve opening. The control of these time points can be individually matched and, within limits, variably matched to the ignition time point.

Because of the omission of a more or less strong return spring serving as a clamping device, the electromagnetic control device can be designed relatively weaker because it does not have to operate with each work stroke against a spring force.

A conventional control device comprising a valve mass and a valve spring defines a system which can vibrate and which operates optimally only at a single frequency, namely, its resonance frequency. For a wide rpm range, return springs of this kind (serving as a clamping device of the control device) are quite unsuitable. Special vibration forms (for example, a rectangle defining an x-t diagram) are practically impossible because of the harmonic (sinusoidally-shaped) fundamental oscillation in the region of resonance. These hindrances are overcome by utilizing an electromagnetically functioning system in the sense of the invention. Since the valve construction according to the invention operates without a return spring, there is no preferred resonance frequency. All frequencies and therefore all engine rpms are excited with same-strength signals to same-magnitude amplitudes, that is, same-size valve deflections and to desired "curve shapes" of the valve openings. The danger of a collision, which is present between the piston base and the valve plate when there is a power loss, is therefore reliably precluded with the aid of the safety lock shaft of the invention which is continuously entrained in "idle" as ancillary equipment.

During normal operation, at least one cam can run behind a collar without contact. The collar is releasably connected to the valve shaft for assembly purposes. In this way, a large variation possibility for the valve stroke as well as for the valve opening time results because of the completely electronic control of the valves with simultaneous mechanical safety.

The safety lock shaft need only displace the valve so far in the direction of the closed position until the valve has left the collision position given by the top dead center of the piston.

In accordance with a preferred embodiment of the invention, the safety lock shaft can additionally delimit the maximum valve stroke in that the base circle of the safety lock shaft determines the maximum stroke. In this way, the lock shaft of the invention also operates in the opposite direction as safety equipment; that is, no separate further configuration is required herefor. However, even with the realization of this feature, the electromagnetic control device can move completely free between the pregiven limit values (maximum valve stroke on the one hand, and closed position, on the other hand).

Furthermore, the safety shaft of the invention can also be used advantageously for a decompression position of the valves in order to protect the engine against excessive wear in cold starts and possibly in combination with an electric oil pump which starts running before.

BRIEF DESCRIPTION OF THE DRAWINGS

In the following, an embodiment of the control device of the invention is described.

DESCRIPTION OF THE PREFERRED EMBODIMENTS OF THE INVENTION

Figure 2:
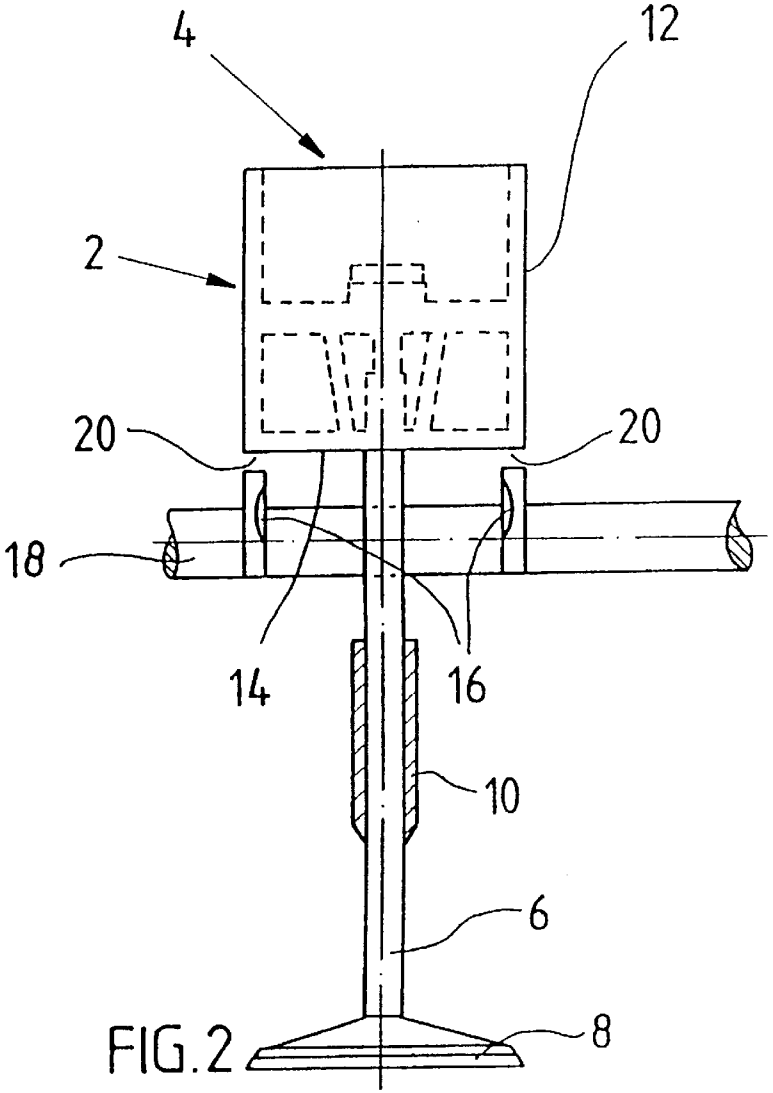
Figure 1:
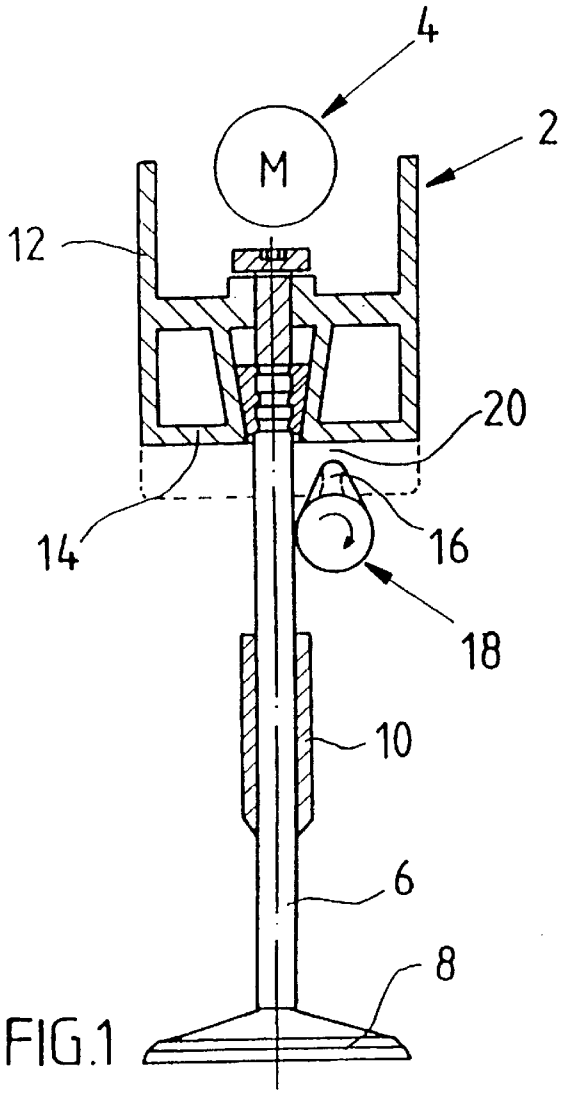
FIG. 1 shows a principle sketch of the electromagnetically operating control device 2 of the invention in longitudinal section; and, FIG. 2 shows a side elevation view of this control device 2.

At the top end of FIG. 1, an electromagnetic control unit 4 is shown as a black box. The electromagnetic control unit 4 has an electric input for receiving electric valve control signals and a mechanical output which is operatively connected via part 12 to a valve shaft 6 having a valve plate 8. The valve shaft 6 projects out of the cylinder head. The part 12 is connected to the core of a coil arrangement, the part 12 can also be part of the core. During operation of the electromagnetic control device 2, the electromagnetic control unit 4 moves part 12 up and down. The valve shaft 6 is guided by a valve shaft guide 10. A safety lock shaft 18 is mounted below the base 14 of the part 12. The safety lock shaft 18 has a cam 16 and is arranged perpendicularly to the valve shaft 6.

The safety lock shaft 18 is a camshaft which is permanently entrained as ancillary equipment. The cam shaft is entrained to run idle at a certain safety spacing, that is, without contact.

The safety lock shaft 18 is arranged perpendicularly next to the valve shaft 6. The cam(s) 16 are disposed below the base 14 of the part 12. If two cams 16 are mounted on the safety shaft 18, then they are disposed symmetrically on both sides of the valve shaft 6.

The form of the cams 16 is so configured with a backcut that, at first, a slow upward pressing of the valve is made possible and, just ahead of top dead center, a rapid upward pressing away from the collision location is ensured. The upper position of the cams 16 corresponds to the top dead center of the piston.

In the electromagnetic control unit 4, the electric control quantity is converted into an analog mechanical force of the same size via a magnetic field intensity analog to the electric control quantity. In this way, the part 12 with the valve 6, which is provided with the valve plate 8, is subjected to a corresponding vertical deflection.

The safety lock shaft 18, which is located below the part 12, runs "idle" in the normal case. More specifically, shaft 18 and cams 16 in the normal case always have a certain spacing 20 to the base 14 of the part 12. Only when there is a power failure or a disturbance as to function of the electromagnetic control unit 4, do the cams 16 lift the base 14 of the part 12 including the valve plate 8, which is located on the valve shaft 6, so that a collision between piston base and valve plate 8 is avoided. The camshaft 18 of the invention thereby serves merely as a safety lock shaft.

What is claimed is:

1. An electromagnetically operating control device for at least one gas-exchange valve assembly of a reciprocating piston engine having a crankshaft and a cylinder in which a piston having a base reciprocates, the control device comprising:

a safety lock shaft driven by said crankshaft in a ratio of 1:1;

said gas-exchange valve assembly including a plate for opening and closing a valve opening in said cylinder; an electromagnetically driven actuator which is subject to disturbances affecting the operability thereof; a mechanism for transmitting movement to said plate to perform the opening and closing operation of said valve opening; and, said actuator being operatively connected to said mechanism for imparting movement thereto; and, said safety lock shaft having at least one cam disposed thereon for engaging and displacing said mechanism by an amount sufficient to reliably prevent a collision between said base of said piston and said plate when said disturbance occurs.

2. The electromagnetically operating control device of claim 1, said mechanism including a valve shaft connected to said plate; a collar fixedly connected to said valve shaft; said collar and said cam conjointly defining a distance therebetween; and, said cam trailing said collar by said distance during the normal operation without making contact therewith.

3. The electromagnetically operating control device of claim 2, said safety lock shaft defining a base circle; and, said cam and said base circle limiting the maximum stroke of said valve shaft and said plate.

4. The electromagnetically operating control device of claim 1, wherein said at least one valve assembly can be adjusted in a decompression system with the aid of said safety lock shaft having said cam.

* * * * *